US011078878B1

(12) United States Patent
Thorat et al.

(10) Patent No.: US 11,078,878 B1
(45) Date of Patent: Aug. 3, 2021

(54) FUEL RAIL NOZZLE RETENTION BRACKET

(71) Applicants: Abhijeet Thorat, Troy, MI (US); Sunil Waghmare, Rochester Hills, MI (US)

(72) Inventors: Abhijeet Thorat, Troy, MI (US); Sunil Waghmare, Rochester Hills, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 16/749,587

(22) Filed: Jan. 22, 2020

(51) Int. Cl.
*F02M 63/00* (2006.01)
*F02M 63/02* (2006.01)

(52) U.S. Cl.
CPC ... *F02M 63/0275* (2013.01); *F02M 2200/857* (2013.01); *F02M 2200/9015* (2013.01)

(58) Field of Classification Search
CPC .. F02M 63/0275; F02M 55/004; F02M 55/02; F02M 2200/857; F02M 2200/9015; F02M 2700/00; F02D 19/0697
See application file for complete search history.

(56) References Cited

U.S. PATENT DOCUMENTS 4,457,280 A 7/1984 Hudson, Jr.
4,519,368 A 5/1985 Hudson, Jr.
4,751,904 A * 6/1988 Hudson, Jr. ..... F02M 69/465 123/470
4,782,808 A * 11/1988 Bostick ..... F02M 69/465 123/514
4,798,187 A * 1/1989 Hudson, Jr. ..... F02M 69/465 123/447
4,991,556 A * 2/1991 Mahnke ..... F02M 69/465 123/463
5,074,272 A * 12/1991 Bostick ..... F02M 69/465 123/514
5,090,385 A * 2/1992 Usui ..... F02M 69/465 123/468
5,390,638 A 2/1995 Hornby et al.
5,423,303 A 6/1995 Bennett
6,341,595 B1 * 1/2002 Scollard ..... F02M 55/004 123/456
8,061,332 B1 * 11/2011 Harbert ..... F02M 51/005 123/469
8,371,270 B2 * 2/2013 Ishii ..... B62J 37/00 123/510
2009/0133676 A1 * 5/2009 Lepsch ..... F02M 55/02 123/549
2009/0217911 A1 * 9/2009 Yokura ..... F02M 37/42 123/457
2015/0159574 A1 6/2015 Stack et al.
2017/0306909 A1 * 10/2017 Tanaka ..... F02M 69/465
2018/0087693 A1 * 3/2018 Dhanasekaran ..... B60K 15/01
2018/0216587 A1 * 8/2018 Morimoto ..... B60K 15/01
2019/0010904 A1 * 1/2019 Sasaki ..... F02M 37/0017

* cited by examiner

*Primary Examiner* — Phutthiwat Wongwian
*Assistant Examiner* — Sherman D Manley
(74) *Attorney, Agent, or Firm* — Ralph E. Smith

(57) ABSTRACT

A fuel rail retention bracket for a fuel rail assembly having a fuel rail fluidly coupled to a fuel line includes a main body, a first connecting end configured to couple to the fuel rail, and a second connecting end configured to couple to the fuel line. The main body and first and second connecting ends are configured to prevent relative displacement between the fuel line and the fuel rail to maintain the coupling between the fuel rail and the fuel line.

18 Claims, 4 Drawing Sheets

FUEL RAIL NOZZLE RETENTION BRACKET

FIELD

The present application relates generally to vehicle fuel rail assemblies and, more particularly, to a structural fuel rail nozzle retention bracket to facilitate preventing relative movement between fuel rail assembly components.

BACKGROUND

Some vehicles include fuel rail assemblies for supplying fuel to an internal combustion engine. The fuel rail assemblies typically include a fuel line connected to an engine mounted fuel rail, which distributes fuel to a plurality of individual fuel injectors. In some high speed impact events, due to possible relative displacement between the fuel line and the engine/fuel rail, the fuel line can potentially become separated from the fuel rail, which may make it possible for fuel to leak from the fuel rail assembly. To prevent relative displacement between the engine and fuel line, some systems mount the fuel line directly to the engine block, thereby increasing cost, assembly time, and serviceability time. Thus, while such conventional systems do work well for their intended purpose, there remains a desire for improvement in the relevant art.

SUMMARY

According to one example aspect of the invention, a fuel rail retention bracket for a fuel rail assembly having a fuel rail fluidly coupled to a fuel line is provided. In one example configuration, the fuel rail retention bracket includes a main body, a first connecting end configured to couple to the fuel rail, and a second connecting end configured to couple to the fuel line. The main body and first and second connecting ends are configured to prevent relative displacement between the fuel line and the fuel rail to maintain the coupling between the fuel rail and the fuel line.

In addition to the foregoing, the described fuel rail retention bracket may include one or more of the following features: wherein the main body and first and second connecting members are fabricated from a rigid material; wherein the main body and first and second connecting members are fabricated from a plastic nylon material; wherein the first connecting end is sized and shaped to interferingly clip to the fuel rail; wherein the first connecting end includes a pair of opposed semi-circular arms sized and shaped to removably fit around and grasp the fuel rail; wherein the second connecting end is sized and shaped to interferingly clip to the fuel line; and wherein the second connecting end includes a pair of opposed semi-circular arms sized and shaped to removably fit around and grasp the fuel line.

In addition to the foregoing, the described fuel rail retention bracket may include one or more of the following features: wherein the main body includes a first outer structural member coupled between the first and second connecting ends, a second outer structural member coupled between the first and second connecting ends, and an inner structural member disposed between the first and second outer structural members; wherein the main body further comprises a pair of vertical structural members coupled between the first and second outer structural members; wherein the main body further comprises a pair of angled structural members disposed between the pair of vertical structural members and the first and second outer structural members; wherein a first portion of the inner structural member is coupled to and extends between the first connecting end and a first vertical structural member of the pair of vertical structural members; and wherein a second portion of the inner structural member is coupled to and extends between the second connecting member and a second vertical structural member of the pair of vertical structural members.

According to another example aspect of the invention, a fuel rail assembly for a vehicle having an internal combustion engine is provided. In one example configuration, the fuel rail assembly includes a fuel rail configured to mount to the internal combustion engine, a fuel line fluidly coupled to the fuel rail, and a fuel rail retention bracket coupled between the fuel rail and the fuel line. The fuel rail retention bracket includes a main body, a first connecting end configured to couple to the fuel rail, and a second connecting end configured to couple to the fuel line. The main body and first and second connecting ends are configured to prevent relative displacement between the fuel line and the fuel rail to maintain the coupling between the fuel rail and the fuel line.

In addition to the foregoing, the described fuel rail assembly may include one or more of the following features: wherein the main body and first and second connecting members are fabricated from a rigid material; wherein the first connecting end is sized and shaped to interferingly clip to the fuel rail, and wherein the second connecting end is sized and shaped to interferingly clip to the fuel line; and wherein the first connecting end includes a pair of opposed semi-circular arms sized and shaped to removably fit around and grasp the fuel rail, and wherein the second connecting end includes a pair of opposed semi-circular arms sized and shaped to removably fit around and grasp the fuel line.

In addition to the foregoing, the described fuel rail assembly may include one or more of the following features: wherein the main body includes a first outer structural member coupled between the first and second connecting ends, a second outer structural member coupled between the first and second connecting ends, and an inner structural member disposed between the first and second outer structural members; wherein the main body further includes a pair of vertical structural members coupled between the first and second outer structural members, and a pair of angled structural members disposed between the pair of vertical structural members and the first and second outer structural members; and wherein a first portion of the inner structural member is coupled to and extends between the first connecting end and a first vertical structural member of the pair of vertical structural members, and wherein a second portion of the inner structural member is coupled to and extends between the second connecting member and a second vertical structural member of the pair of vertical structural members.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DESCRIPTION

The present application is directed to a vehicle fuel rail assembly having a structural support or retention bracket coupled between a fuel rail and a fuel line. The support bracket is coupled between the fuel rail and the fuel line to prevent relative displacement therebetween, thereby facilitating preventing leaks that can occur if the fuel rail and the fuel line are separated during an impact event. The support bracket can be quickly added or removed by hand, thereby providing easy serviceability and reduced assembly effort than compared to direct mounting of the fuel line to the engine.

Figure 1:
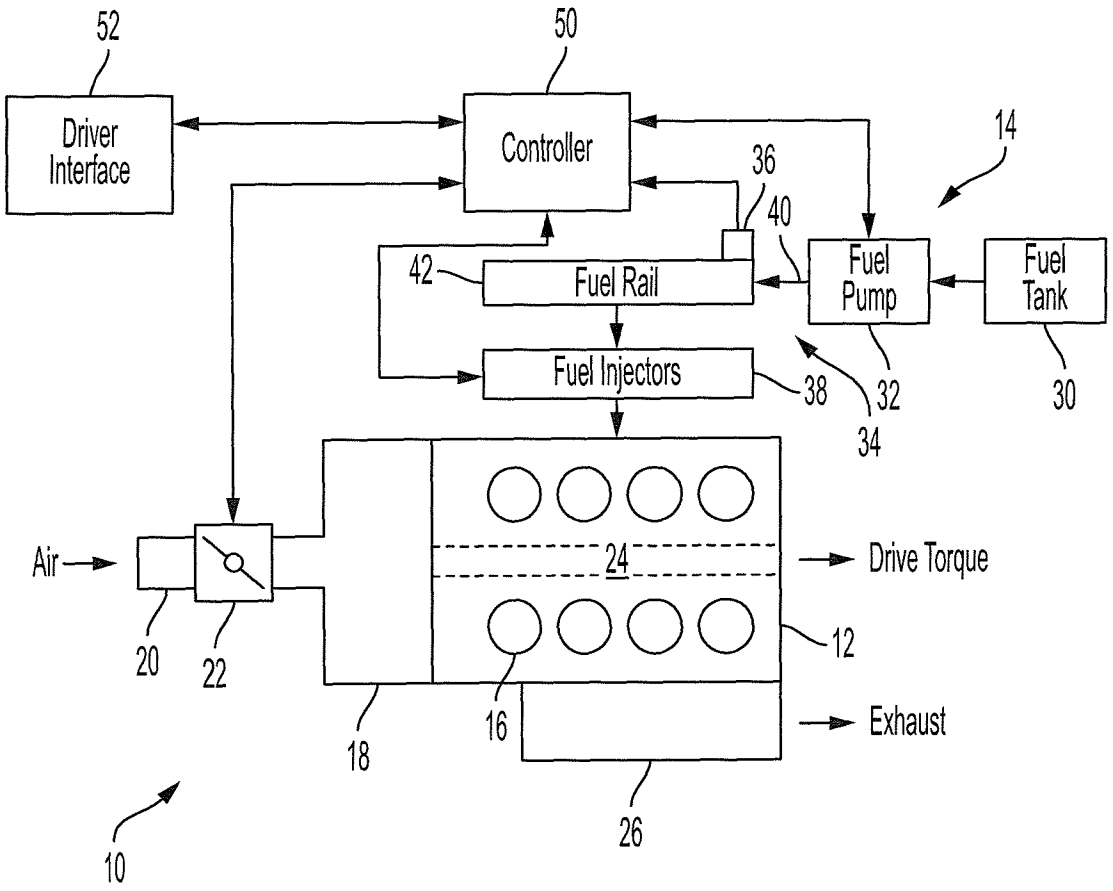
FIG. 1 is a schematic view of an example engine system according to the principles of the present disclosure.

Referring now to the drawings, FIG. 1 illustrates an example engine system 10 that generally includes an internal combustion engine 12 operably associated with a fuel system 14. The engine 12 can be any suitable engine equipped with a variable pressure fuel system. Examples of engine 12 include a spark ignition (SI) engine such as a direct injection (DI) engine or a port fuel injection (PFI) engine (also known as a sequential fuel injection, or SFI engine), and a non-SI engine such as a diesel engine. The engine 12 includes a plurality of cylinders 16. While eight cylinders are shown, it will be appreciated that the engine 12 can include other numbers of cylinder such as, for example, four or six cylinders.

In the example embodiment, engine 12 is configured to draw air into an intake manifold 18 through an induction system 20 regulated by a throttle 22. The air in the intake manifold is distributed to the cylinders 16 and combined with fuel to create an air/fuel mixture that is subsequently compressed and combusted within the cylinders 16 to drive pistons (not shown) that rotatably turn a crankshaft 24 to generate drive torque. The drive torque is then transferred to a drivetrain (not shown) to propel a vehicle. Exhaust gas resulting from combustion is expelled from the cylinders 16 into an exhaust system 26 configured to treat the exhaust gas before releasing it to the atmosphere.

Figure 2:
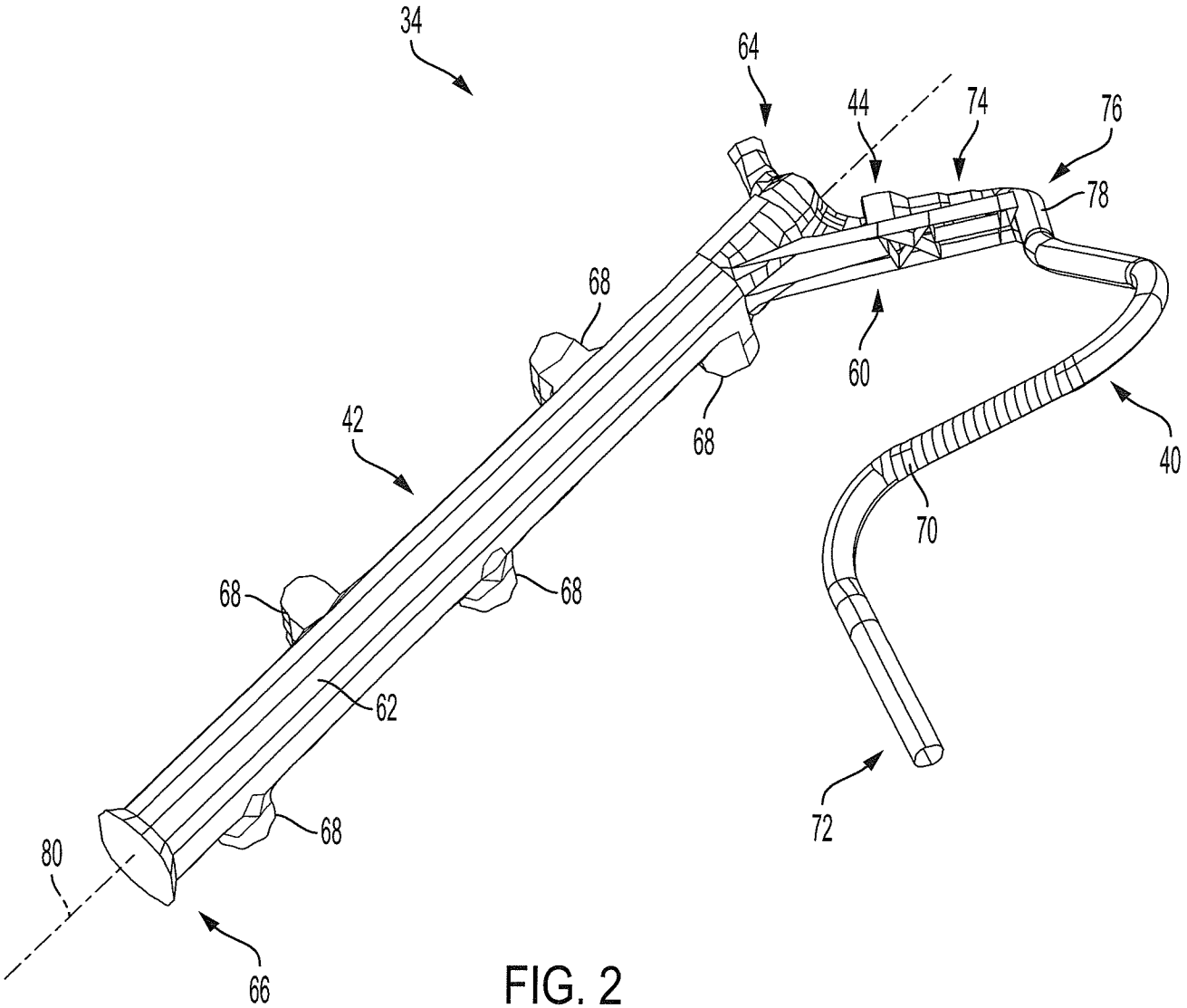
FIG. 2 is a perspective view of an example fuel rail assembly that may be utilized with the engine system shown in FIG. 1, in accordance with the principles of the present disclosure.

In the example implementation, the fuel system 14 generally includes a fuel tank 30, a fuel pump 32, a fuel rail assembly 34, a fuel rail pressure sensor 36, and plurality of fuel injectors 38. In one implementation, the fuel system 14 can be a variable pressure fuel system. The fuel rail assembly 34 generally includes a fuel line 40 fluidly coupled to a fuel rail 42, for example, via a quick connect 44 (FIG. 2). The fuel pump 32 is configured to supply pressurized fuel from the fuel tank 30 to the fuel rail 42 via the fuel line 40. In one example, the fuel pump 32 is a high pressure fuel pump. Additionally, the fuel system 14 may include two or more fuel pumps such as, for example, a high pressure fuel pump and a low pressure fuel pump. The fuel rail pressure sensor 36 is configured to measure a pressure of the fuel in the fuel rail 42, which pressure typically depends on the type of engine (e.g., DI, PFI, etc.).

The fuel injectors 38 are configured to be periodically opened to inject fuel from the fuel rail 42 into the engine 12. The injection point of the fuel injectors 38 depends on the type of engine 12 (e.g., DI, PFI, etc.). For example, in a DI engine the fuel injectors 38 are configured to inject fuel directly into the cylinders 16, whereas in a PFI engine the fuel injectors 38 are configured to inject fuel via intake ports of the cylinders 16. It will be appreciated that the fuel system 14 can include any other suitable components that enable engine system 10 to operate as described herein. For example, the fuel system 14 may include a fuel tank sensor and/or a pressure relief valve configured to selectively decrease the fuel rail pressure in order to prevent damage to the fuel rail 42.

A controller 50 can control operation of the engine system 10. Specifically, the controller 50 can control the engine 12 to generate a desired torque in response to a torque request from a driver of the vehicle. The torque request can be based on input from the driver via a driver interface 52 such as, for example, an accelerator pedal. As used herein, the term controller refers to an application specific integrated circuit (ASIC), an electronic circuit, a processor (shared, dedicated, or group) and memory that executes one or more software or firmware programs, a combinational logic circuit, and/or other suitable components that provide the described functionality.

Turning now to FIG. 2, in the example embodiment, the fuel rail assembly 34 further includes a structural fuel rail support or retention bracket 60 configured to prevent relative displacement between the fuel rail 42 and the fuel line 40. In the example embodiment, the fuel rail 42 generally includes a tubular body 62 having a proximal end 64 and a distal end 66. The fuel rail body 62 includes a plurality of mounting locations 68 for coupling the fuel rail 42 to a cylinder head (not shown) or other portion of engine 12. The proximal end 64 is configured to fluidly couple to the fuel line 40, for example, via quick connect 44. The fuel line 40 generally includes a conduit 70 having a proximal end 72 and a distal end 74. The proximal end 72 is configured to fluidly couple to the fuel tank 30, and the distal end 74 is configured to couple to the fuel rail proximal end 64, for example, via the quick connect 44. In the illustrated example, the conduit 70 includes a 90° or substantially 90° bend 76 defining a straight portion 78 having at least a non-orthogonal component of orientation relative to a longitudinal axis 80 of extension of the fuel rail 42. As such, in some examples, at least a portion of extension of both the straight portion 78 and the fuel rail 42 are parallel or substantially parallel.

Figure 3:
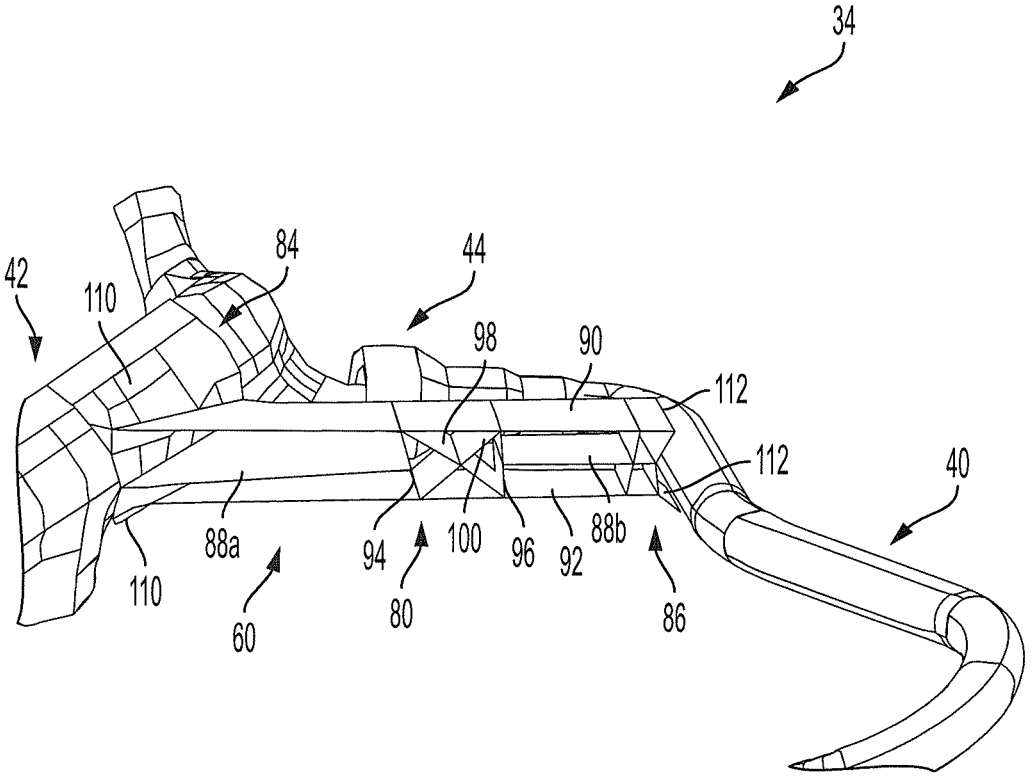
FIG. 3 is an enlarged view of the fuel rail assembly shown in FIG. 2 including an example fuel rail structural bracket, in accordance with the principles of the present disclosure.

With additional reference to FIGS. 3 and 4, the fuel rail retention bracket 60 will be described in more detail. In the example embodiment, the fuel rail retention bracket 60 generally includes a main body 82 having a first connecting end 84 and an opposite second connecting end 86. In one example, fuel rail retention bracket 60 is a rigid member fabricated from a lightweight plastic nylon material. However, it will be appreciated that fuel rail retention bracket 60 may be fabricated from any suitable material that enables fuel rail retention bracket 60 to function as described herein.

In the example embodiment, the main body 82 generally includes an inner structural beam or member 88 disposed between opposed outer structural beams or members 90, 92, a pair of vertical structural beams or members 94, 96, and a pair of angled structural beams or members 98, 100. A first portion 88*a* of the inner structural member 88 is coupled to and extends between the first connecting end 84 and the vertical structural member 94, and a second portion 88*b* of the inner structural member 88 is coupled to and extends between the second connecting end 86 and the vertical structural member 96.

The outer structural member 90 is coupled to and extends between the first connecting end 84 and the second connecting end 86. Similarly, the outer structural member 92 is coupled to and extends between the first connecting end 84 and the second connecting end 86. The first angled structural member 98 is coupled to and extends between an interface between the outer structural member 90 and the vertical structural member 94, and an interface between the outer structural member 92 and the vertical structural member 96. The second angled structural member 100 is coupled to and extends between an interface between the outer structural member 90 and the vertical structural member 96, and an interface between the outer structural member 92 and the vertical structural member 94. As such, main body 82 defines a truss structure configured to provide support between the fuel rail 42 and fuel line 40 and facilitate absorbing forces and preventing separation/buckling of the main body 82 during an impact event. It will be appreciated, however, that the truss structure of main body 82 may have various arrangements depending on various vehicle specific details such as various vehicle designs, various vehicle components, packaging space, impact load, etc.

Figure 4:
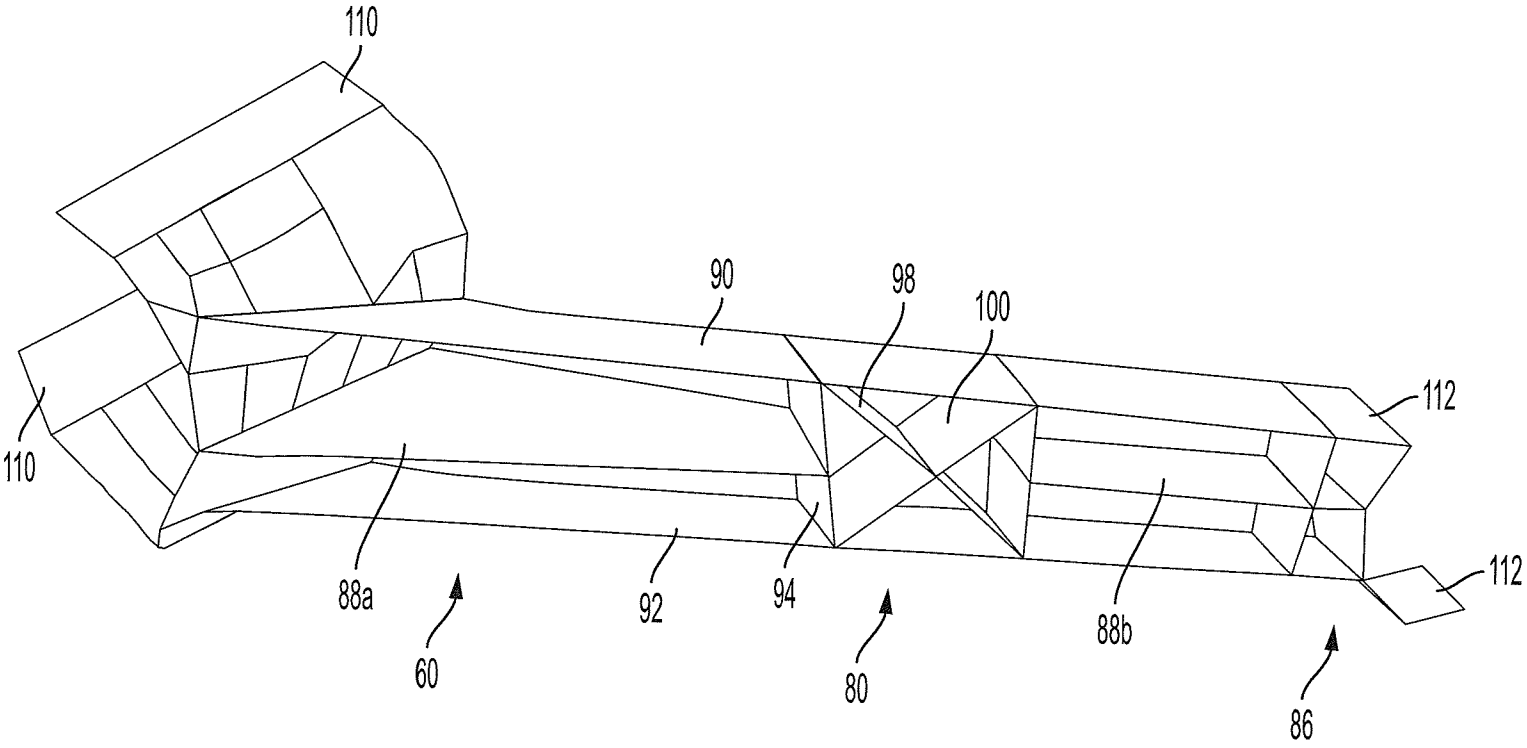
FIG. 4 is a top perspective view of the fuel rail structural bracket shown in FIG. 3, in accordance with the principles of the present disclosure.

With continued reference to FIG. 4, in the example embodiment, the first connecting end 84 includes a pair of opposed, semi-circular arms 110 sized and shaped to fit around, grasp, and secure against the fuel rail 42. The first connecting end 84 provides an interference fit that enables attachment and removal of the first connecting end 84 by hand. Similarly, the second connecting end 86 includes a pair of opposed, semi-circular arms 112 sized and shaped to fit around, grasp, and secure against the fuel line 40. The second connecting end 86 provides an interference fit that enables attachment and removal of the second connecting end 86 by hand. It will be appreciated, however, that first and/or second connecting ends 84, 86 may connect to the fuel rail 42 and the fuel line 40 in any suitable manner that enables fuel rail retention bracket 60 to function as described herein.

Described herein are systems and methods for preventing relative movement between a fuel rail and fuel line, particularly during an impact event. A selectively removable structural clip or bracket is coupled to and secured between the fuel rail and the fuel line to maintain the fluid connection between the fuel rail and fuel line. As such, the structural bracket does not couple to any other vehicle components such as the cylinder head. The structural bracket is a rigid member configured to withstand impact forces, prevent buckling, and prevent relative displacement of the fuel rail/fuel line to prevent shearing of a quick connect between the fuel line and fuel rail.

It should be understood that the mixing and matching of features, elements and/or functions between various examples may be expressly contemplated herein so that one skilled in the art would appreciate from the present teachings that features, elements and/or functions of one example may be incorporated into another example as appropriate, unless described otherwise above.

What is claimed is:

1. A fuel rail retention bracket for a fuel rail assembly having a fuel rail fluidly coupled to a fuel line, the fuel rail retention bracket comprising:

a main body;

a first connecting end configured to couple to the fuel rail; and a second connecting end configured to couple to the fuel line, wherein the main body includes spaced apart first and second outer structural beams extending between the first and second connecting ends, wherein the main body and first and second connecting ends are configured to prevent relative displacement between the fuel line and the fuel rail to maintain the coupling between the fuel rail and the fuel line.

2. A fuel rail retention bracket for a fuel rail assembly having a fuel rail fluidly coupled to a fuel line, the fuel rail retention bracket comprising:

a main body;

a first connecting end configured to couple to the fuel rail; and a second connecting end configured to couple to the fuel line, wherein the main body and first and second connecting ends are configured to prevent relative displacement between the fuel line and the fuel rail to maintain the coupling between the fuel rail and the fuel line, wherein the first connecting end is sized and shaped to interferingly clip to the fuel rail.

3. The fuel rail retention bracket of claim 2, wherein the main body comprises:

a first outer structural member coupled between the first and second connecting ends;

a second outer structural member coupled between the first and second connecting ends; and an inner structural member disposed between the first and second outer structural members.

4. The fuel rail retention bracket of claim 3, wherein the main body further comprises a pair of vertical structural members coupled between the first and second outer structural members.

5. The fuel rail retention bracket of claim 4, wherein the main body further comprises a pair of angled structural members disposed between the pair of vertical structural members and the first and second outer structural members.

6. The fuel rail retention bracket of claim 4, wherein a first portion of the inner structural member is coupled to and extends between the first connecting end and a first vertical structural member of the pair of vertical structural members.

7. The fuel rail retention bracket of claim 6, wherein a second portion of the inner structural member is coupled to and extends between the second connecting member and a second vertical structural member of the pair of vertical structural members.

8. The fuel rail retention bracket of claim 2, wherein the main body and first and second connecting members are fabricated from a rigid material.

9. The fuel rail retention bracket of claim 8, wherein the main body and first and second connecting members are fabricated from a plastic nylon material.

10. The fuel rail retention bracket of claim 2, wherein the first connecting end includes a pair of opposed semi-circular arms sized and shaped to removably fit around and grasp the fuel rail.

11. The fuel rail retention bracket of claim 2, wherein the second connecting end is sized and shaped to interferingly clip to the fuel line.

12. The fuel rail retention bracket of claim 2, wherein the second connecting end includes a pair of opposed semi-circular arms sized and shaped to removably fit around and grasp the fuel line.

13. A fuel rail assembly for a vehicle having an internal combustion engine, the system comprising:

a fuel rail configured to mount to the internal combustion engine;

a fuel line fluidly coupled to the fuel rail; and a fuel rail retention bracket coupled between the fuel rail and the fuel line and comprising:

a main body;

a first connecting end configured to couple to the fuel rail; and a second connecting end configured to couple to the fuel line, wherein the main body and first and second connecting ends are configured to prevent relative displacement between the fuel line and the fuel rail to maintain the coupling between the fuel rail and the fuel line, wherein the first connecting end is sized and shaped to interferingly clip to the fuel rail, and wherein the second connecting end is sized and shaped to interferingly clip to the fuel line.

14. The fuel rail assembly of claim 13, wherein the main body comprises:

a first outer structural member coupled between the first and second connecting ends;

a second outer structural member coupled between the first and second connecting ends; and an inner structural member disposed between the first and second outer structural members.

15. The fuel rail assembly of claim 14, wherein the main body further comprises:

a pair of vertical structural members coupled between the first and second outer structural members; and a pair of angled structural members disposed between the pair of vertical structural members and the first and second outer structural members.

16. The fuel rail assembly of claim 15, wherein a first portion of the inner structural member is coupled to and extends between the first connecting end and a first vertical structural member of the pair of vertical structural members, and wherein a second portion of the inner structural member is coupled to and extends between the second connecting member and a second vertical structural member of the pair of vertical structural members.

17. The fuel rail retention bracket of claim 13, wherein the main body and first and second connecting members are fabricated from a rigid material.

18. The fuel rail assembly of claim 13, wherein the first connecting end includes a pair of opposed semi-circular arms sized and shaped to removably fit around and grasp the fuel rail, and wherein the second connecting end includes a pair of opposed semi-circular arms sized and shaped to removably fit around and grasp the fuel line.

* * * * *